US005406777A

United States Patent [19]

Porto

[11] Patent Number: 5,406,777

[45] Date of Patent: Apr. 18, 1995

[54] GRASS HOPPER CART

[76] Inventor: Aldo Porto, 2331 Weatherford Land, Naperville, Ill. 60565-3237

[21] Appl. No.: 94,622

[22] Filed: Jul. 21, 1993

[51] Int. Cl.[6] ..... B65B 67/00; B65B 67/12

[52] U.S. Cl. ..... 53/513; 53/390; 53/570; 248/97; 248/98

[58] Field of Search ..... 53/512, 370, 384.1, 53/432, 459, 513, 390, 527, 570, 551; 182/17, 35, 93; 248/98, 99, 97; 83/100, 402, 98; 16/44

[56] References Cited

U.S. PATENT DOCUMENTS

| | | | |
|---|---|---|---|
| 110,511 | 12/1870 | Swogger | 248/97 |
| 1,759,424 | 5/1930 | Strauss | 16/44 |
| 2,798,652 | 7/1957 | Easton | 182/17 |
| 3,322,477 | 5/1967 | Armijo | 53/570 |
| 3,468,095 | 9/1969 | Vogt | 53/432 |
| 3,552,521 | 1/1971 | Tate | 182/17 |
| 3,858,905 | 1/1975 | Peebles | 182/93 |
| 3,905,406 | 9/1975 | Cruse | 53/390 |
| 3,925,963 | 12/1975 | Greenawalt | 53/551 |
| 3,935,692 | 2/1976 | Miller | 53/370 |
| 4,688,371 | 8/1987 | Hecht | 53/570 |
| 5,129,609 | 7/1992 | Tobin | 248/99 |
| 5,155,975 | 10/1992 | Knowler | 53/527 |

*Primary Examiner*—Linda B. Johnson
*Assistant Examiner*—Rodney A. Butler
*Attorney, Agent, or Firm*—Michael I. Kroll

[57] ABSTRACT

A grass hopper cart is provided, which consists of a cabinet and a structure within the cabinet for holding a standard paper bag in an opened stationary position. A hopper is placed into the cabinet above the holding structure, so that grass cuttings dumped into the hopper will enter the paper bag for proper disposal.

10 Claims, 2 Drawing Sheets

36
20
38
24
26
28
32
64
12
52
46
50
60
6
14
56
2
18
54
58
40
22
66
44
48
68
4
62
34

GRASS HOPPER CART

BACKGROUND OF THE INVENTION

Field of the Invention

The instant invention relates generally to gardening equipment and more specifically it relates to a grass hopper cart.

Description of the Prior Art

Numerous gardening equipment have been provided in prior art that are adapted to pick up grass cuttings, leaves, small branches and other debris left on the lawn. While these units may be suitable for the particular purpose to which they address, they would not be as suitable for the purposes of the present invention as heretofore described.

SUMMARY OF THE INVENTION

A primary object of the present invention is to provide a grass hopper cart that will overcome the shortcomings of the prior art devices.

Another object is to provide a grass hopper cart that will help a person to dump grass cuttings into a standard paper bag.

An additional object is to provide a grass hopper cart that will hold the standard paper bag in a stationary opened position under a hopper, so as to prevent the accidental spillage of the grass cuttings therefrom.

A further object is to provide a grass hopper cart that is simple and easy to use.

A still further object is to provide a grass hopper cart that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4:
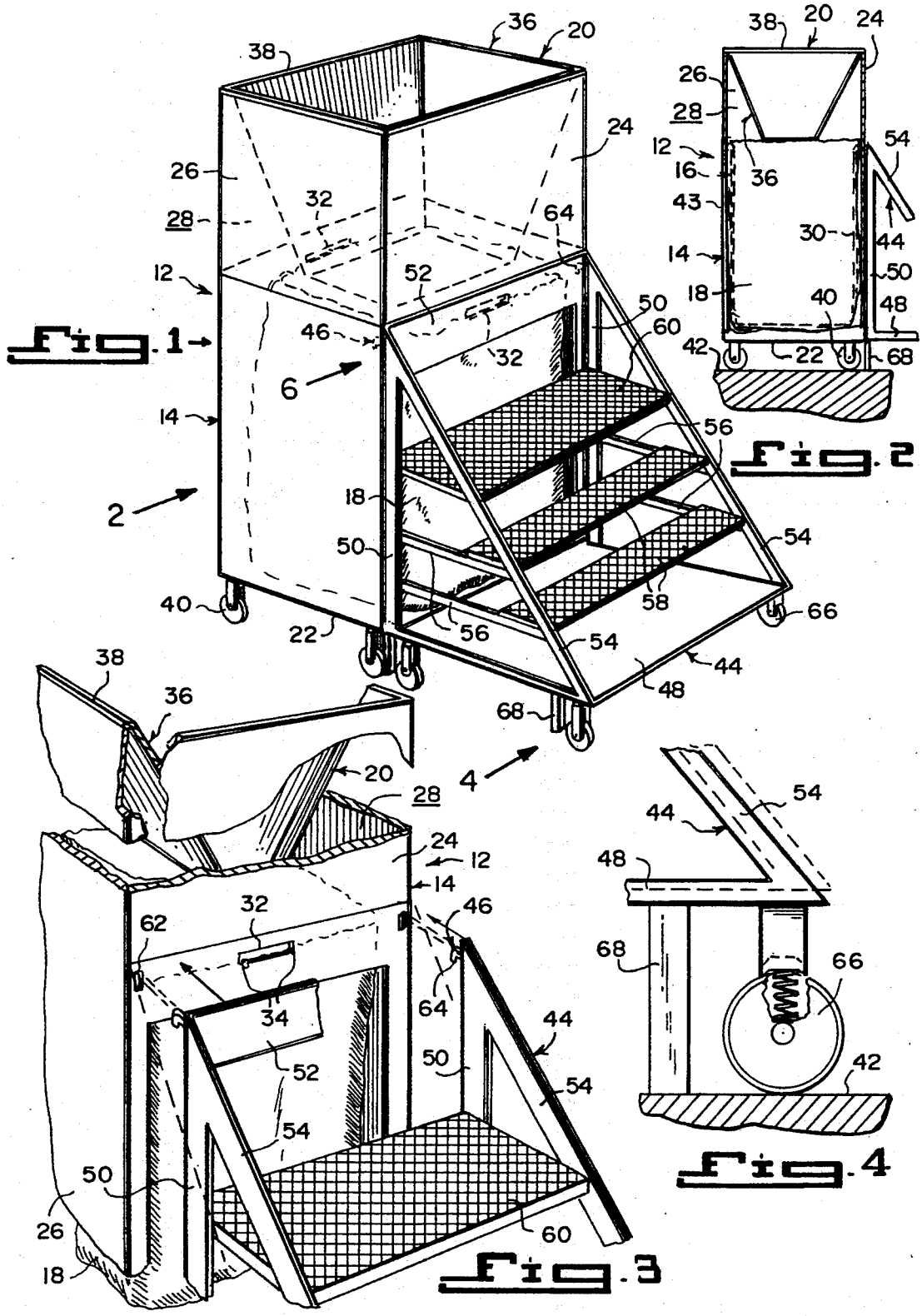
FIG. 1 is a front perspective view of the instant invention.
FIG. 2 is a side view taken in the direction of arrow 2 in FIG. 1, with parts broken away.
FIG. 3 is a front perspective view of a portion of the instant invention, showing the portable staircase ramp ready to be attached to the cabinet.
FIG. 4 is an enlarged side view of a portion of the portable staircase ramp as indicated by arrow 4 in FIG. 1, showing one of the wheels in greater detail.
Figure 5:
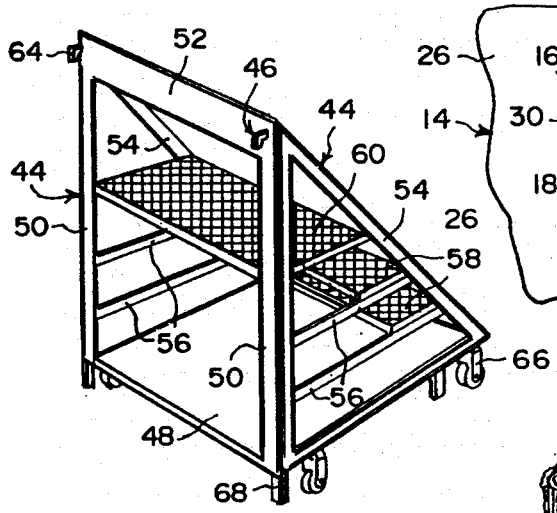
FIG. 5 is a rear perspective view of the portable staircase ramp.
Figure 6:
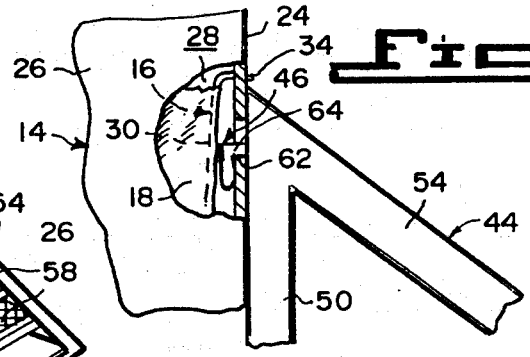
FIG. 6 is an enlarged side view of a portion of the instant invention as indicated by arrow 6 in FIG. 1 with parts broken away, showing how the connector tab of the portable staircase ramp engaging within the aperture in the cabinet.
Figure 7:
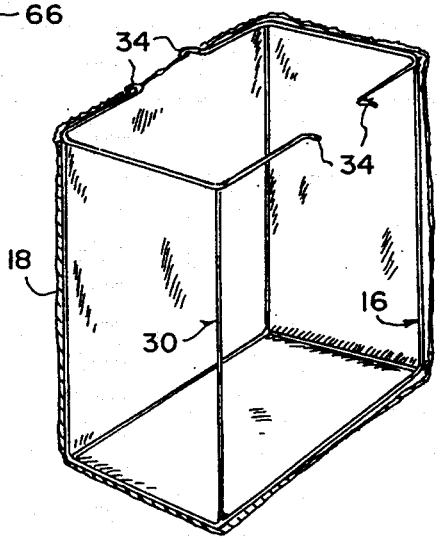
FIG. 7 is a perspective view of the paper bag broken away, showing the wire frame therein.
Figure 8:
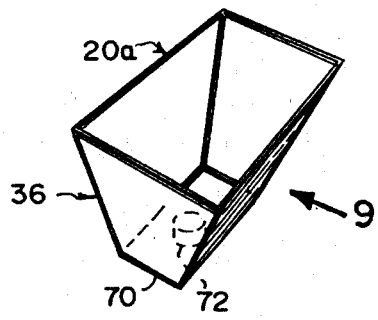
FIG. 8 is a perspective view of a second type of hopper used for mixing various materials therein.
Figure 9:
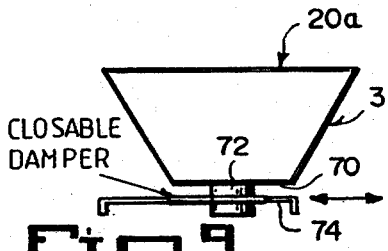
FIG. 9 is an elevational view of the second type of hopper taken in the direction of arrow 9 in FIG. 8.

Turning now descriptively to the drawings, in which similar reference characters denote similar elements throughout the several views, FIGS. 1, 2 and 3 illustrate a grass hopper cart 12, which consists of a cabinet 14 and a structure 16 within the cabinet 14, for holding a standard paper bag 18 in an opened stationary position (see FIG. 7). A hopper 20 placed into the cabinet 14 above the holding structure 16, so that grass cuttings dumped into the hopper 20 will enter the paper bag 18 for proper disposal.

The cabinet 14 includes a bottom wall 22, with a pair of side walls 24 extending upwardly from the bottom wall 22. A pair of end walls 26 extend upwardly from the bottom wall 22, to form a compartment 28 therein for the holding structure 16 and the hopper 20.

The holding structure 16 is a wire frame 30 sized to fit into the standard paper bag 18, so as to keep the standard paper bag 18 in the opened stationary position. Each of the side walls 24 of the cabinet 14 has a horizontal slot 32 therethrough. The wire frame 30 has extending from each opposite side of its top end, a pair of hooks 34 to engage with one horizontal slot 32 in one side wall 24 of the cabinet 14, so as to suspend the wire frame 30 with the standard paper bag 18 therefrom.

The hopper 20 is a generally funnel-shaped container 36, having a lip 38 about its upper periphery to sit upon the open top of the cabinet 14, so that it will guide the grass cuttings into the standard paper bag 18 below.

Figure 12:
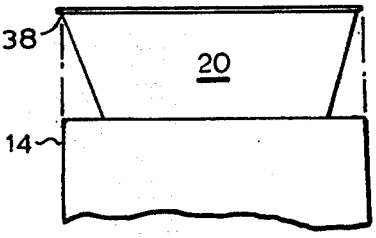
FIG. 12 is a side elevation detail view illustrating the interfitting relationship of the hopper to the cabinet.

When hopper 20 is placed upon cabinet 14, lip 38 comes to rest upon a rectangular supporting surface formed by the tops of side walls 24 and end walls 26. This relationship is shown in the detail of FIG. 12.

The cabinet 14 further includes a plurality of wheel units 40, mounted to the underside of the bottom wall 22, to make the cabinet 14 portable. It can be moved easily from place to place by the wheel units 40 rolled upon a flat ground surface 42. One of the side walls 24 of the cabinet 14 has a large opening 43 therethrough, so that the paper bag 18 can be easily removed from and installed onto the wire frame 30.

The grass hopper cart 12, as shown in FIGS. 1 through 6, further contains a portable staircase ramp 44 and an assembly 46, for coupling the portable staircase ramp 44 to one of the side walls 24 of the cabinet 14. A person can stand upon the portable staircase ramp 44, to dump the grass cuttings into the hopper 20.

The portable staircase ramp 44 consists of a base plate 48 and a pair of riser side rails 50, with each extending upwardly perpendicular from a rear corner of the base plate 48. A cross rail 52 extends horizontally between the upper ends of the riser side rails 50. A pair of stringer side rails 54 are also provided. Each extends upwardly at an angle from a front corner of the base plate 48, to connect with the upper end of one riser side rail 50. A plurality of support rails 56 extend horizontally in spaced apart parallel positions between the riser side rails 50 and the stringer side rails 54, about each side of the base plate 48. A stair tread 58 is mounted horizontally between two support rails 56. A platform 60 is mounted horizontally between the riser side rails 50 and the stringer side rails 54, above the highest stair tread 58.

The coupling assembly 46 includes one side wall 24 of the cabinet 14, having a pair of spaced apart vertical slots 62 therethrough. A pair of connector tabs 64 are affixed in a spaced apart relationship, to the back of the cross rail 52. The connector tabs 64 can engage with the vertical slots 62 in the side wall 24 of the cabinet 14.

The portable staircase ramp 44 further contains a plurality of spring biased wheel units 66, mounted to the underside of the base plate 48 (see FIG. 4). A plurality of legs 68 are mounted to the underside of the base plate 48. The legs 68 are shorter in length than the spring biased wheel units 66. When a person steps onto the portable staircase ramp 44, the weight will cause the spring biased wheel units 66 to collapse. The base plate 48 will be supported on the legs 68 to keep the portable staircase ramp 44 in a stationary position, even when the connector tabs 64 are in engagement with the vertical slots 62 in the side wall 24 of the cabinet 14.

A second type of hopper 20*a*, shown in FIGS. 8, 9, 10 and 11 includes a bottom wall 70 across a bottom portion of the generally funnel-shaped container 36, so as to mix various materials therein. An exit pipe chute 72 extends downwardly from the bottom wall 70. A sliding damper 74 is in the exit pipe chute 72, so as to open and close the exit pipe chute 72, to transfer the mixed material into other receptacles.

Figure 11:
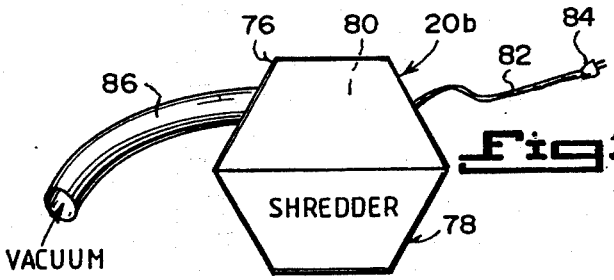
FIG. 11 is an elevational view of a third type of hopper that is a combination vacuum and shredder.
Figure 10:
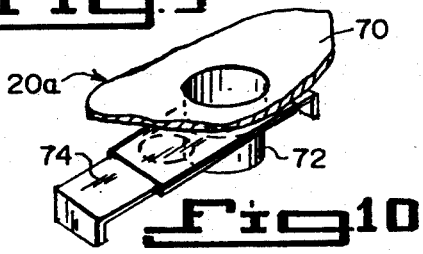
FIG. 10 is a perspective view of a portion of the second type of hopper, showing the sliding damper in greater detail.

A third type of hopper 20*b*, as shown in FIG. 11, contains a wet and dry vacuum unit 76 built therein. A shredder unit 78 is also built therein. Various materials can be sucked into the hopper 20*b* and shredded into smaller particles, to be deposited into the paper bag 18.

The wet and dry vacuum unit 76 includes a suction motor 80. an electrical cord 82 is connected to the suction motor 80. A plug 84 is connected to a distal end of the electrical cord 82, so that it can engage with a socket to provide power to the suction motor 80. An elongated hose 86 is connected to the suction motor 80, so as to draw the various materials into the shredder unit 78 by the suction motor 80. The motor and fan of the vacuum unit 76 are disposed in conventional fashion at the top of and inside the container formed by hopper 20*b*. Grass cuttings are picked up in hose 86 and conducted by vacuum into hopper 20*b*.

In the embodiment employing shredder unit 78 in addition to vacuum unit 76, vacuum unit 76 transports cuttings to shredder unit 78. Shredded cuttings are then discharged to the paper bag supported by wire frame 30, in the manner of the first embodiment employing hopper 20 (see FIG. 1).

| LIST OF REFERENCE NUMBERS | |
|---|---|
| 12 | grass hopper cart |
| 14 | cabinet |
| 16 | holding structure |
| 18 | standard paper bag |
| 20 | first hopper |
| 20a | second hopper |
| 20b | third hopper |
| 22 | bottom wall of 14 |
| 24 | side wall of 14 |
| 26 | end wall of 14 |
| 28 | compartment in 14 |
| 30 | wire frame for 16 |

-continued

| LIST OF REFERENCE NUMBERS | |
|---|---|
| 32 | horizontal slot in 24 |
| 34 | hook on 30 |
| 36 | generally funnel-shaped container for 20 |
| 38 | lip on 36 |
| 40 | wheel unit on 22 |
| 42 | flat ground surface |
| 43 | large opening in 24 |
| 44 | portable staircase ramp |
| 46 | coupling assembly |
| 48 | base plate |
| 50 | riser side rail |
| 52 | cross rail |
| 54 | stringer side rail |
| 56 | support rail |
| 58 | stair tread |
| 60 | platform |
| 62 | vertical slot in 24 |
| 64 | connector tab on 52 |
| 66 | spring biased wheel unit on 48 |
| 68 | leg |
| 70 | bottom wall of 20a |
| 72 | exit pipe chute on 70 |
| 74 | sliding damper |
| 76 | wet and dry vacuum unit |
| 78 | shredder unit |
| 80 | suction motor |
| 82 | electrical cord |
| 84 | plug on 82 |
| 86 | elongated hose |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A grass hopper cart comprising:

a) a cabinet having a bottom wall, a pair of side walls extending upwardly from said bottom wall, each one side wall having means defining a slot therein, and a pair of end walls extending upwardly from said bottom wall to form a compartment therein, the tops of said pair of side walls and said pair of end walls defining an upper top surface of said cabinet;

b) means disposed within said cabinet for holding a standard paper bag in an opened, stationary position, comprising a wire frame having a top and opposite sides, said wire frame sized to fit into a standard paper bag, so as to maintain the standard paper bag in an opened positions said wire frame having a pair of hooks extending from said opposite sides at said top of said wire frame, each said hook engaging one said slot, both said hooks suspending said wire frame when engaging said slots; and c) a generally funnel shaped hopper having an upper periphery and a lip projecting outwardly from said upper periphery, said lip coming to rest upon said cabinet upper top surface, thus supporting said hopper when said hopper is placed in said cabinet, said hopper guiding grass cuttings into a paper bag when a paper bag is held within said cabinet.

2. A grass hopper cart as recited in claim 1, wherein said cabinet further includes a plurality of wheel units mounted to the underside of said bottom wall to make said cabinet portable, so that it can be moved easily from place to place by said wheel units rolled upon a flat ground surface.

3. A grass hopper cart as recited in claim 2, wherein one of said side walls of said cabinet having a large opening therethrough, so that the paper bag can be easily removed from and installed onto said wire frame.

4. A grass hopper cart as recited in claim 3, further including:

a) a portable staircase ramp; and b) means for coupling said portable staircase ramp to one of said side walls of said cabinet, so that a person can stand upon said portable staircase ramp to dump the grass cutting into said hopper.

5. A grass hopper cart as recited in claim 4, wherein said portable staircase ramp includes:

a) a base plate;

b) a pair of riser side rails, each extending upwardly perpendicular from a rear corner of said base plate;

c) a cross rail extending horizontally between the upper ends of said riser side rails;

d) a pair of stringer side rails, each extending upwardly at an angle from a front corner of said base plate, to connect with the upper end of one said riser side rail;

e) a plurality of support rails extending horizontally in spaced apart parallel positions between said riser side rails and said stringer side rails above each side of said base plate;

f) a plurality of stair treads, each mounted horizontally between two said support rails; and g) a platform mounted horizontally between said riser side rails and said stringer side rails above said highest stair tread.

6. A grass hopper cart as recited in claim 5, wherein said coupling means includes:

a) said one side wall of said cabinet having a pair of spaced apart vertical slots therethrough; and b) a pair of connector tabs affixed in a spaced apart relationship to the back of said cross rail, so that said connector tabs can engage with said vertical slots in said side wall of said cabinet.

7. A grass hopper cart as recited in claim 6, wherein said portable staircase ramp further includes:

a) a plurality of spring biased wheel units mounted to the underside of said base plate; and b) a plurality of legs mounted to the underside of said base plate, said legs are shorter in length than said spring biased wheel units, so that when a person steps onto said portable staircase ramp, the weight will cause said spring biased wheel units to collapse, allowing said base plate to be supported on said legs to keep said portable staircase ramp in a stationary position, even when said connector tabs are in engagement with said vertical slots in said side wall of said cabinet.

8. A grass hopper cart as recited in claim 7, wherein said hopper includes:

a) a bottom wall across a bottom portion of said generally funnel-shaped container, so as to mix various materials therein;

b) an exit pipe chute extending downwardly from said bottom wall; and c) a sliding damper in said exit pipe chute, so as to open and close said exit pipe chute to transfer the mixed materials into other receptacles.

9. A grass hopper cart as recited in claim 7, wherein said hopper includes:

a) a wet and dry vacuum unit built therein; and b) a shredder unit built therein, so that various materials can be sucked into said hopper and shredded into smaller particles, to be deposited into the paper bag.

10. A grass hopper cart as recited in claim 9, wherein said wet and dry vacuum unit includes:

a) a suction motor;

b) an electrical cord connected to said suction motor;

c) a plug connected to a distal end of said electrical cord, so that it can engage with a socket, to provide power to said suction motor; and d) an elongated hose connected to said suction motor, so as to draw the various materials into said shredder unit by said suction motor.

* * * * *